US010086977B2

(12) United States Patent
Ruha et al.

(10) Patent No.: US 10,086,977 B2
(45) Date of Patent: Oct. 2, 2018

(54) HOLDING DEVICE FOR FLUID MEDIUM

(71) Applicant: WARNER MANUFACTURING COMPANY, Minneapolis, MN (US)

(72) Inventors: David J. Ruha, New Hope, MN (US); William G. Laramy, Eagan, MN (US)

(73) Assignee: Warner Manufacturing Company, Plymouth, MN (US)

( * ) Notice: Subject to any disclaimer, the term of this patent is extended or adjusted under 35 U.S.C. 154(b) by 906 days.

(21) Appl. No.: 14/466,573

(22) Filed: Aug. 22, 2014

(65) Prior Publication Data

US 2015/0053708 A1 Feb. 26, 2015

Related U.S. Application Data

(60) Provisional application No. 61/868,718, filed on Aug. 22, 2013.

(51) Int. Cl.

| | |
|---|---|
| ***B65D 25/00*** | (2006.01) |
| ***B65D 25/28*** | (2006.01) |
| ***B65D 21/02*** | (2006.01) |
| ***B44D 3/12*** | (2006.01) |

(52) U.S. Cl.

CPC ..... *B65D 25/2852* (2013.01); *B44D 3/12* (2013.01); *B44D 3/126* (2013.01); *B65D 21/0233* (2013.01); *Y10T 29/49826* (2015.01)

(58) Field of Classification Search

CPC .. B65D 25/2852; B65D 21/0233; B44D 3/12; B44D 3/126; Y10T 29/49826

USPC ..... 220/772

See application file for complete search history.

(56) References Cited

U.S. PATENT DOCUMENTS

| | | | | | |
|---|---|---|---|---|---|
| 2,705,334 | A * | 4/1955 | Farrow | B44D 3/121 | 15/257.06 |
| 2,777,142 | A * | 1/1957 | Lo Verde | B44D 3/126 | 15/257.06 |
| 2,827,648 | A * | 3/1958 | Geisz | B44D 3/128 | 15/257.05 |
| 3,351,970 | A * | 11/1967 | Engh | B44D 3/126 | 15/257.06 |
| 4,765,123 | A * | 8/1988 | Caldwell | B44D 3/126 | 220/570 |
| 4,928,843 | A * | 5/1990 | Gunderson | B44D 3/126 | 15/257.06 |
| 5,085,317 | A * | 2/1992 | Jensen | B25H 3/06 | 15/257.06 |
| D345,832 | S | 4/1994 | Fraze et al. | | |
| 5,400,916 | A * | 3/1995 | Weber | B44D 3/126 | 15/257.05 |

(Continued)

*Primary Examiner* — Ernesto Grano

(74) *Attorney, Agent, or Firm* — Hamre, Schumann, Mueller & Larson, P.C.

(57) ABSTRACT

A fluid medium holding device may include a holder body having a plurality of side walls, a bottom wall and an opening defined by the side walls that allows access to an interior space of the holder body. The holding device may also include a first handle attached to the first wall of the holder body and pivotable about a first pivot axis; and a second handle attached to the second wall of the holder body and pivotable about a second pivot axis. The first and second handles can be folded on an upper edge of the holder body with the first and second handles positioned generally parallel to each other.

18 Claims, 12 Drawing Sheets

(56) References Cited

U.S. PATENT DOCUMENTS 5,404,611 A * 4/1995 Raney ..... B44D 3/123 15/257.06
5,884,955 A * 3/1999 Pucillo ..... A45C 13/26 294/169
6,019,241 A * 2/2000 Burns ..... B44D 3/126 15/257.06
6,101,658 A * 8/2000 Shehow ..... B05C 17/00 15/166
6,102,235 A * 8/2000 Stern ..... B44D 3/126 15/257.06
6,199,718 B1 * 3/2001 Ellis ..... B44D 3/126 220/570
D444,604 S * 7/2001 Hoffert ..... D32/53.1
6,494,340 B1 * 12/2002 Joo ..... A63B 71/0045 220/485
D524,003 S * 6/2006 Prokop ..... D32/53.1
D524,501 S * 7/2006 Prokop ..... D32/53.1
7,137,168 B2 * 11/2006 Mann ..... B44D 3/128 15/257.06
D551,411 S * 9/2007 Byers ..... D32/53.1
7,410,074 B1 * 8/2008 Brunning ..... B44D 3/126 15/257.06
7,484,637 B2 * 2/2009 Cutler, Sr. ..... B05C 17/0245 220/495.02
7,665,626 B2 * 2/2010 Alvares ..... B44D 3/127 206/45.28
7,784,145 B1 * 8/2010 Prokop ..... B44D 3/126 15/257.06
7,959,030 B2 6/2011 Bergman
7,963,418 B2 * 6/2011 Arvinte ..... B44D 3/126 220/495.02
8,162,169 B2 4/2012 Bergman et al.
8,444,000 B2 5/2013 Bergman et al.
8,701,242 B2 * 4/2014 DeHart ..... B44D 3/126 15/257.05
D715,053 S * 10/2014 Frey ..... D3/318
8,851,318 B1 * 10/2014 Sherman ..... B44D 3/128 220/570
D728,884 S * 5/2015 Waffensmith ..... D32/54
9,108,768 B2 * 8/2015 Bruno ..... A47J 47/18
D786,061 S * 5/2017 Snedden ..... D9/425
2004/0226958 A1 * 11/2004 Robellard ..... B44D 3/126 220/772
2005/0098564 A1 * 5/2005 Verbrugge ..... B44D 3/126 220/570
2005/0269327 A1 * 12/2005 Chafe ..... B44D 3/12 220/270
2006/0226156 A1 * 10/2006 Lundy ..... B44D 3/128 220/570

* cited by examiner

HOLDING DEVICE FOR FLUID MEDIUM

FIELD

This disclosure relates generally to fluid medium holding devices, and more particularly, but not by way of limitation, to holding devices for holding a fluid medium as well as for carrying an implement for spreading the fluid medium upon a surface.

BACKGROUND

Holding devices, such as trays, buckets, pails, etc., are commonly used for holding a fluid medium, for example, paint, stain, sealer, other liquid coating, cleaning products such as window cleaning solutions, or the like, in a quantity and at a level that is suitable for loading an implement, for example, a paint roller, with a desired and controllable amount of the fluid medium for transferring and spreading the fluid medium onto a selected surface. In such circumstances, the user typically holds the holding device in one hand and manipulates the implement, such as a paint roller, a paint brush, or the like, by the other hand to distribute the fluid medium on the selected surface. When a paint roller is in use, the holding devices typically include a textured panel for controlling the amount of the fluid medium on the paint roller.

SUMMARY

Some embodiments of a fluid medium holding device can be configured to have two handles attached on opposite walls of a holder body. The two handles can be oriented in a double-handle position to allow the holding device to be maintained stable when the double handles are held in a user's hand. For example, the handles can be configured to have a length that generally equals to a distance between the pivot axes of the two handles so as to allow the user to readily extend an implement through openings defined by the handles and the respective edge of the holder body where the handles are attached. The two handles can also be oriented in a folded-in position, thereby allowing one handle to be folded on top of the other.

Moreover, the fluid medium holding device can be configured to include a pivotable paint roll-off panel. For example, the panel can be positioned in a working position inside the holder body to allow a paint roller to roll off excess paint and in a non-working position to allow the panel to be positioned outside of the holder body, thereby providing a larger volume in the holder body for storage, transport or display.

Further, the fluid medium holding device can be configured to include a hand grip that is readily graspable by the user. For example, the hand grip can takes a form of a recess formed on a bottom wall of the holder body. In such circumstances, one of the handles of the holding device can serve as a support brace for the user's hand and cooperate with the hand grip to readily position the holding device at desired angles.

Particular embodiments include a fluid medium holding device. The holding device may include a holder body having a plurality of side walls, a bottom wall and an opening defined by the side walls that allows access to an interior space of the holder body. The holding device may also include a first handle attached to the first wall of the holder body and pivotable about a first pivot axis; and a second handle attached to the second wall of the holder body and pivotable about a second pivot axis. The first and second handles can be folded on an upper edge of the holder body with the first and second handles positioned generally parallel to each other.

In some embodiments, a fluid medium holding device may include a holder body having a first wall, a second wall opposite to the first wall, side walls extending between the first and second wall and a bottom wall. The holding device may also include a first handle attached to the first wall of the holder body and pivotable about a first pivot axis; and a second handle attached to the second wall of the holder body and pivotable about a second pivot axis. A first handle may be nestable on an upper rim of the holder body, and the second handle may be foldable on top of the first handle such that a plane defined by the second handle is parallel to a plane defined by the first handle.

Other embodiments may include a method of handling a fluid medium holding device. The holding device may include a holder body having a plurality of side walls, a bottom wall and an opening defined by the side walls that allows access to an interior space of the holder body. The holding device may also include a pivotable panel attached to one of the side walls of the holder body. The method may include positioning the pivotable panel inside the holder body such that the pivotable panel is oriented in a slanted orientation; and pivoting the pivotable panel outside of the holder body such that the pivotable panel is oriented along an outer surface to which the pivotable panel is attached.

The details of one or more embodiments of the invention are set forth in the accompanying drawings and the description below. Other features, objects, and advantages of the invention will be apparent from the description and drawings, and from the claims.

DESCRIPTION OF THE DRAWINGS

Like reference symbols in the various drawings indicate like elements.

DETAILED DESCRIPTION

A holding device can be configured to hold a fluid medium in a quantity and at a level that is suitable for loading an implement, for example, a paint roller, with a desired and controllable amount of the fluid medium for transferring and spreading the fluid medium onto a selected surface. When used herein, the term "fluid medium" refers to a flowable medium, including but not limited to, liquids (e.g., paint, stain, sealer, other liquid coating, cleaning products, or the like), small solid particles, or the like. The term "implement" refers to tools that can be used to apply the fluid medium on a selected surface.

For ease of description, the fluid medium holding devices described below are described with reference to a paint holding device. However, it is to be understood that the present devices may be employed to hold other fluid media, such as, but not limited to paint, stain, sealer, other liquid coating, cleaning products, or the like.

Also, for convenience of explanation, the implements described below are described with reference to paint rollers or paint brushes. However, it is to be understood that other implements suitable for transferring and spreading a fluid medium onto a selected surface are within the scope of this disclosure. It is to be understood that different types of implements can be employed at the same time in association with the fluid medium holding devices. For example, a paint brush and a paint roller can be employed together for a same project.

The terms "above," "on," "under," "top," "bottom," "up," "down," "upper," "lower," "horizontal," "vertical," "front," "rear," "left," "right" and the like used herein are in reference to the relative positions of the fluid medium holding device, and its constituent parts, as oriented in the specific figures being described. These terms are not meant to be limiting in any way.

Figure 1:
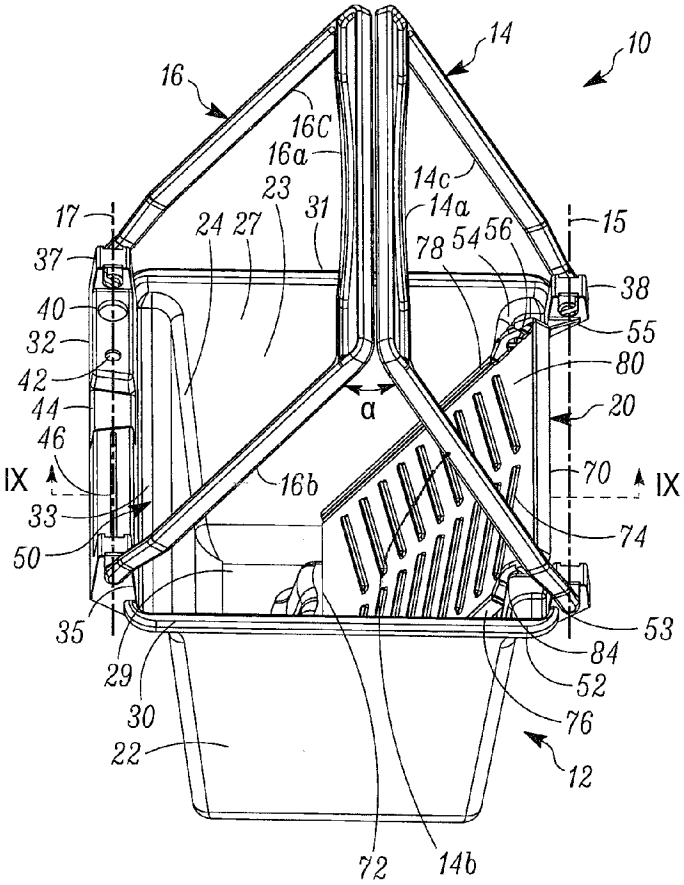
FIG. 1 is a perspective top view of a fluid medium holding device, with handles oriented in a double-handle position, in accordance with some embodiments.
Figure 2:
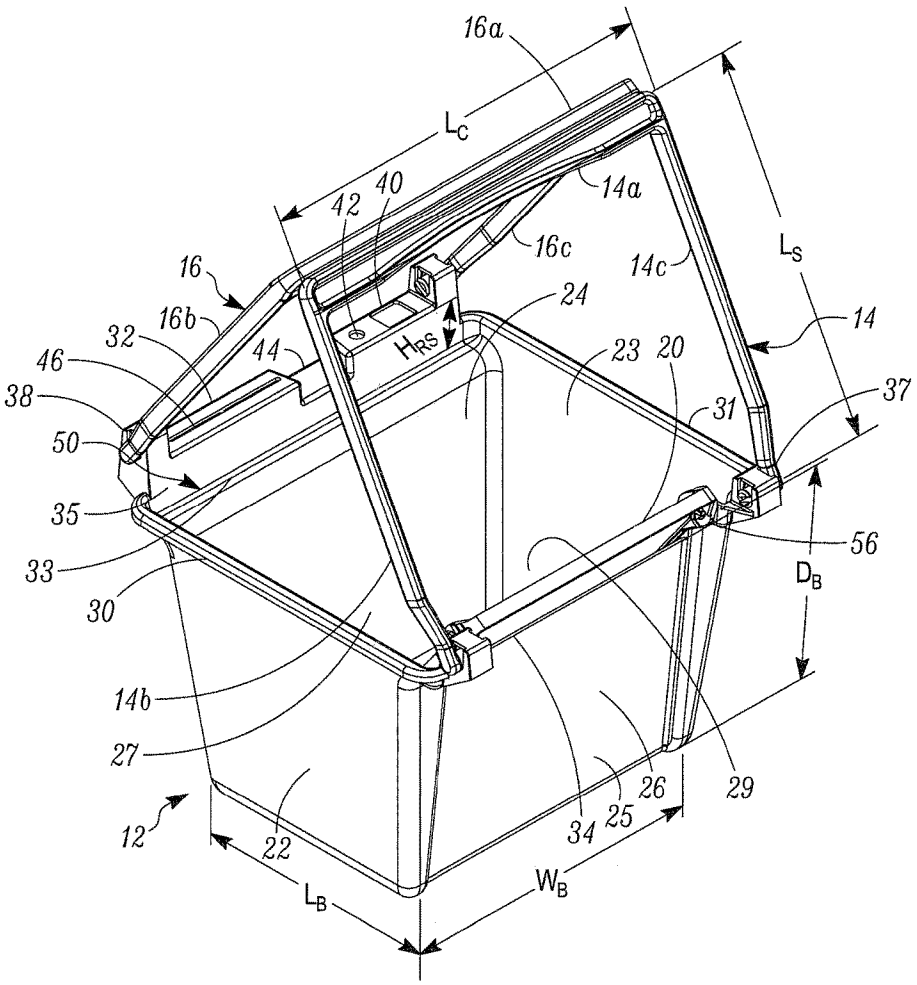
FIG. 2 is a further perspective view of the holding device of FIG. 1, with the handles oriented in the double-handle position.
Figure 3:
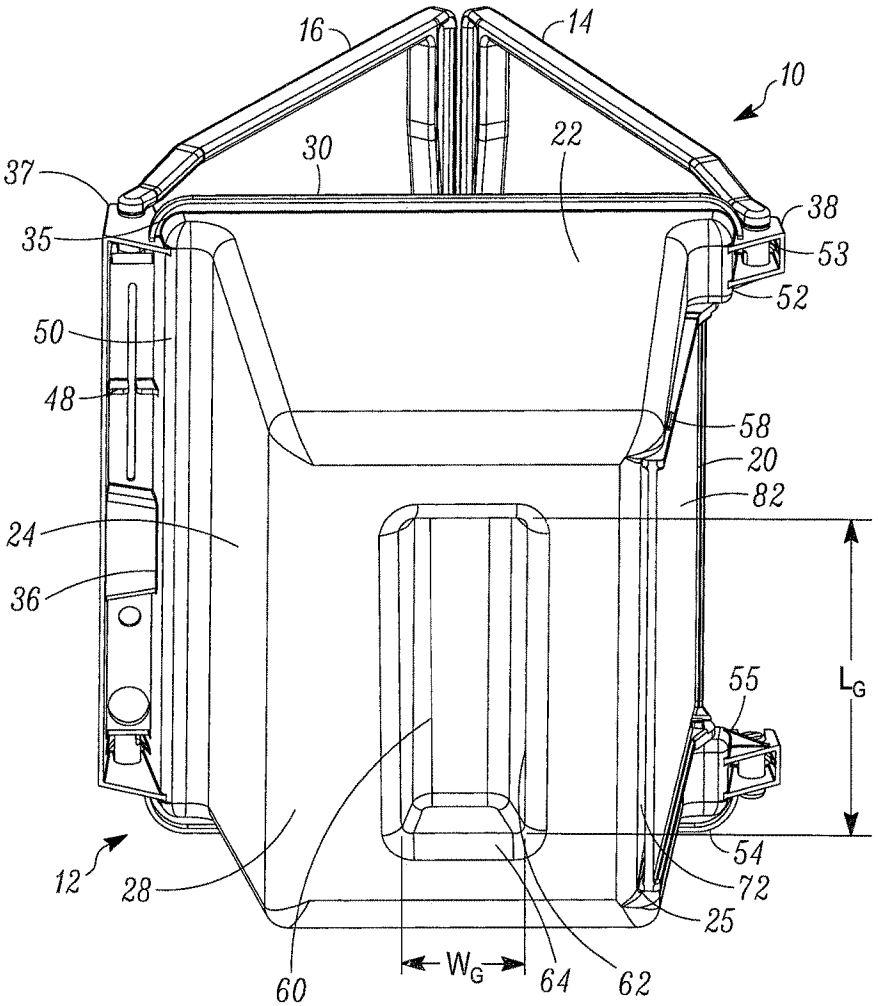
FIG. 3 is a perspective bottom view of the holding device of FIG. 1, with the handles oriented in the double-handle position.

Referring to FIGS. 1-3, a fluid medium holding device 10 includes a holder body 12, a front handle 14 and a rear handle 16 attached to the holder body 12, and a pivotable paint roll-off panel 20 attached to the holder body 12.

The holder body 12 has a first side wall 22, a second side wall 23, a front wall 26, a rear wall 24 and a bottom wall 28. The upper edges of the first and second side walls 22, 23 and the front and rear walls 26, 24 define an opening 27, allowing access to an interior space 29 of the holding device 10.

In some embodiments, the holder body 12 has a width $W_B$ of about 7 inches, a length $L_B$ of about 6 inches and a depth of about 5 inches. The maximum dimension of this holder body 12, for example the length $L_B$ or the width $W_B$ can be relatively smaller than the maximum dimension of a standard paint roller tray, thereby allowing easier storage of the holding device 10. On the other hand, some embodiments can readily accommodate a 4-inch or 6-inch paint roller, and the volume of such a holder body 12 can hold approximately ⅓ gallon of paint sufficient to complete most small to medium painting projects.

It is to be understood that the dimensions of the holder body 12 can be modified as designed. In some embodiments, the width $W_B$ of the holding device 10 can be greater to fit a 9-inch standard paint roller.

Referring to FIGS. 1-3, the first side wall 22 has an upper rim 30, and the second side wall 23 has an upper rim 31. As described in more detail below, in some embodiments, the upper rims 30, 31 can be generally of an identical height relative to the bottom wall 28, allowing the front handle 14 to rest on the upper rims 30, 31 in a parallel position.

At a location in a vicinity of the opening 27 of the holder body 12, the rear wall 24 laterally flanges outwardly to form a rear shelf 50. The rear shelf 50 has a bottom wall 33. A rear edge 36 of the rear shelf 50 extends upwardly beyond the upper rims 30, 31 of the first and second walls 22, 23 and forms a side wall 35 of the rear shelf 50. In some instances, when the user needs to avoid placing an implement, such as a roller portion of a paint roller, in the paint contained in the holding device 10, the user can place the roller portion on the bottom wall 33 of the rear shelf 50 formed on the rear wall 24 of the holder body 12 against the side wall 35 of the rear shelf 50, thereby allowing the roller portion to rest on the rear shelf 50. The rear shelf side wall 35 of the rear shelf 50 has a height $H_{RS}$ (referring to FIG. 6). Attachment members 37 for attachment of the rear handle 16 are formed on top of the rear shelf side wall 35. As described in more detail below, the rear shelf side wall 35 of the rear shelf 50 can be configured to cooperate with the upper rims 30, 31 to allow the front handle 14 to nest on the upper rims 30, 31.

Still referring to FIGS. 1-3, on the front side of the holder body 12, at a location in a vicinity of the opening 27, the front wall 26 also laterally flanges outwardly to form a shelf, with a cutout to facilitate attachment of the paint roll-off panel 20. As a result, a first front shelf 52 and a second front shelf 54 are formed on two sides of the panel 20, respectively. A front edge of each of the first and second front shelves 52, 54 extends upwardly to match the upper rims 30, 31 and forms a first front shelf side wall 53 and a second front shelf side wall 55 of the front shelves 52, 54, respectively, such that the upper ends of the first and second front shelf side walls 53, 55 are leveled with the upper rims 30, 31 of the first and second side walls 22, 23.

As described in more detail below, in some embodiments, the first and second front shelf side walls 53, 55 of the front shelves 52, 54 have a generally identical height $H_{FS}$ (referring to FIG. 6). In some embodiments, the height $H_{FS}$ of the first and second front shelf side walls 53, 55 of the front shelves 52, 54 is smaller than the height $H_{RS}$ of the rear shelf side wall 35 of the rear shelf 50. Attachment members 38 for attachment of the front handle 14 are formed on top of the first and second front shelf side walls 53, 55, respectively. Because the height $H_{FS}$ of the first and second front shelf side walls 53, 55 is smaller than the height $H_{RS}$ of the rear shelf side wall 35, the attachment members 38 is positioned lower than the attachment members 37. This allows the rear handle 16 to be folded over the folded front handle 14. It is to be understood that other configurations of the rear shelf side wall 35, the first and second front shelf side walls 53, 55 can be employed to allow the attachment members 38 for the front handle 14 to be positioned lower than the attachment members 37 for the rear handle 16.

Referring to FIGS. 1 and 2, to facilitate attachment of the paint roll-off panel 20, attachment members 56 are formed adjacent the first and second front shelf side walls 53, 55 respectively for attachment of the panel 20. Also, the front wall 26 of the holder device 12 is configured to have a reduced height such that an upper end 34 of the front wall 26 is positioned lower than the upper rims 30, 31 of the first and second side walls 22, 23 to provide a clearance for an upper end of the panel 20 to pivot around a pivot axis.

Referring to FIGS. 2 and 3, in some embodiments, on the front side of the holder body 12, a recessed area 25 is formed on an outer surface of the front wall 26 that is configured to receive at least partially the thickness of panel 20. At least one retention element 58 is formed on the holder body 12 adjacent the recessed area 25 for retention of the panel 20 to the outer surface of the front wall 26. In some embodiments, the retention element 58 retains the panel 20 by a snap fit connection. However, other measures can be employed to retain the panel 20 to the outer surface of the front wall 26.

Referring to FIGS. 1-3, an upper end of the rear shelf side wall 35 of the rear edge 36 extends rearwardly, forming an upper rim 32 of the rear wall 24. In some embodiments, the upper rim 32 is configured as a tool holder for holding various tools. For example, the upper rim 32 can include a holding aperture 40 for receiving a handle of a hand tool such as a wire brush or paint brush, or a rag used in painting processes. The upper rim 32 may be configured to also include a holding aperture 42 for receiving a shank of a hand tool such as a screwdriver, and a slot 46 for receiving a blade of a hand tool such as a putty knife or scraper. As shown in FIG. 3, ribs 48 can be formed on a bottom surface of the upper rim 32 extending transversely relative to the slot for further holding the blade of the hand tool in place, thereby keeping the hand tool held in the slot 46 from pivoting.

As shown in FIGS. 1 and 2, the upper rim 32 of the rear wall 24 can be configured to also include a holding channel 44 to receive a portion of a hand tool, such as a handle of a paint brush (also referring to FIG. 4) in the channel. It is to be understood that the upper rim 32 on the rear wall 24 can be configured to hold other types of tools as desired. In some embodiments, the upper rim 32 is not configured as a tool holder, but has a similar configuration as the upper rims 30, 31 formed on the first and second side walls 22.

Referring to FIG. 3, some embodiments of the holding device 10 may include a hand grip 60 that can, for example, allow the user to grasp onto a portion of the holder body 12 and position the holding device 10 at different angles. In some embodiments, the hand grip 60 can take a form of a recess formed on the bottom wall 28 of the holder body 12 that is readily graspable by the user. As described in more detail below, in such circumstances, the hand grip 60 can cooperate with the front handle 14 or the rear handle 16 to allow the user to readily position the holding device 10 at different angles. In the embodiment depicted in FIG. 3, the hand grip 60 is an elongate recess located in the middle portion of the bottom wall 28 extending along the front and rear walls 26, 24. The hand grip 60 has front and rear walls 62, side walls 64 and a top wall 66. The hand grip 60 is sized to have a length $L_G$, a width $W_G$, and a height $H_G$ suitable for the user's fingers to grip. In some embodiments, at least a portion of the hand grip 60 can be configured such as textured or built with grooves to provide a better grip for the user.

In some embodiments, the holder body 12 can be fabricated from a variety of materials, such as plastic material, molded in a single piece from a number of plastics, such as polypropolene, polyethylene, nylon, polystyrene, or the like.

Referring now to FIGS. 1-8, the front handle 14 and the rear handle 16 of the holder body 12 are mounted on the opposite walls, such as the front wall 26 and the rear wall 24, respectively. The front and rear handles 14, 16 are configured to be arranged in a double-handle position (referring to FIGS. 1-3), in a folded-in position (referring to FIGS. 5-6), in a folded-down position (referring to FIGS. 4 and 7), or in a position to assist in support of an implement (referring to FIG. 8).

Referring to FIGS. 1-8, the front handle 14 has a first side bar 14*b*, a second side bar 14*c* opposite to the first side bar 14*b*, and a cross bar 14*a* extending between distal ends of the first side bar 14*b* and the second side bar 14*c*. A front handle pivot axis 15 extends through proximal ends of the side bars 14*b*, 14*c* that are attached to the front wall 26 of the holder body 12.

Figure 5:
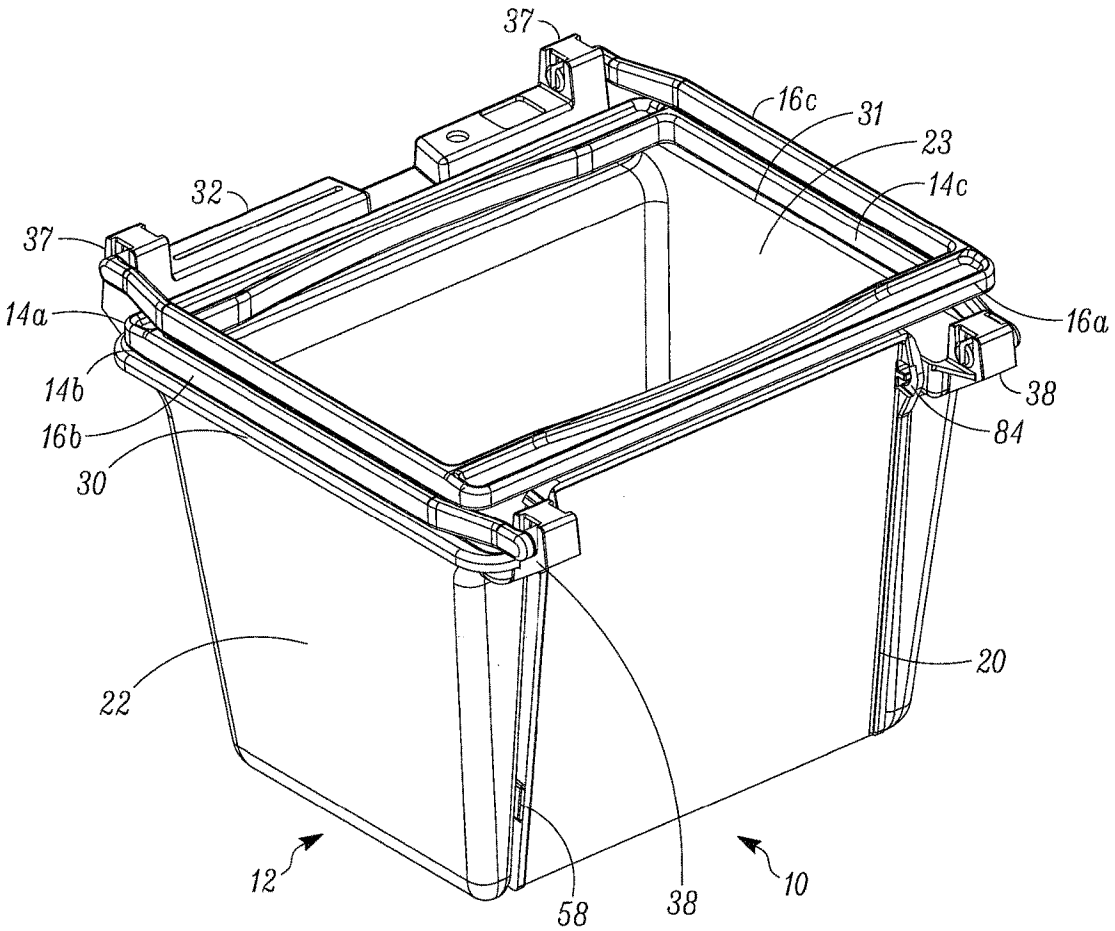
FIG. 5 is a perspective view of the holding device of FIG. 1, with the handles oriented in a folded-in position.

The rear handle 16 has a first side bar 16*b*, a second side bar 16*c* opposite to the first side bar 16*b*, and a cross bar 16*a* extending between distal ends of the first side bar 16*b* and second side bar 16*c*. A rear handle pivot axis 17 extends through proximal ends of the side bars 16*b*, 16*c* that are attached to the rear wall 24 of the holder body 12. As shown in FIGS. 5 and 6, when attached to the holder body 12, the front handle pivot axis 17 and the rear handle pivot axis 15 are oriented parallel to each other, and the front handle pivot axis 17 is positioned lower than the rear handle pivot axis 15 relative to the upper rims 30, 31 of the first and second side walls 22, 23 of the holder body 12.

In the embodiment depicted in the figures, the first side bar 14*b* and the second side bar 14*c* of the front handle 14 can be configured to have a generally identical length, defined as the length of the front handle 14, and the first side bar 16*b* and the second side bar 16*c* of the rear handle 16 can be configured to have a generally identical length, defined as the length of rear handle 16. In some embodiments, the front handle 14 and the rear handle 16 can have a generally identical length $L_S$. In the depicted embodiment, the cross bar 14*a* of the front handle 14 and the cross bar 16*a* of the rear handle 16 also have a generally identical length $L_C$.

Figure 6:
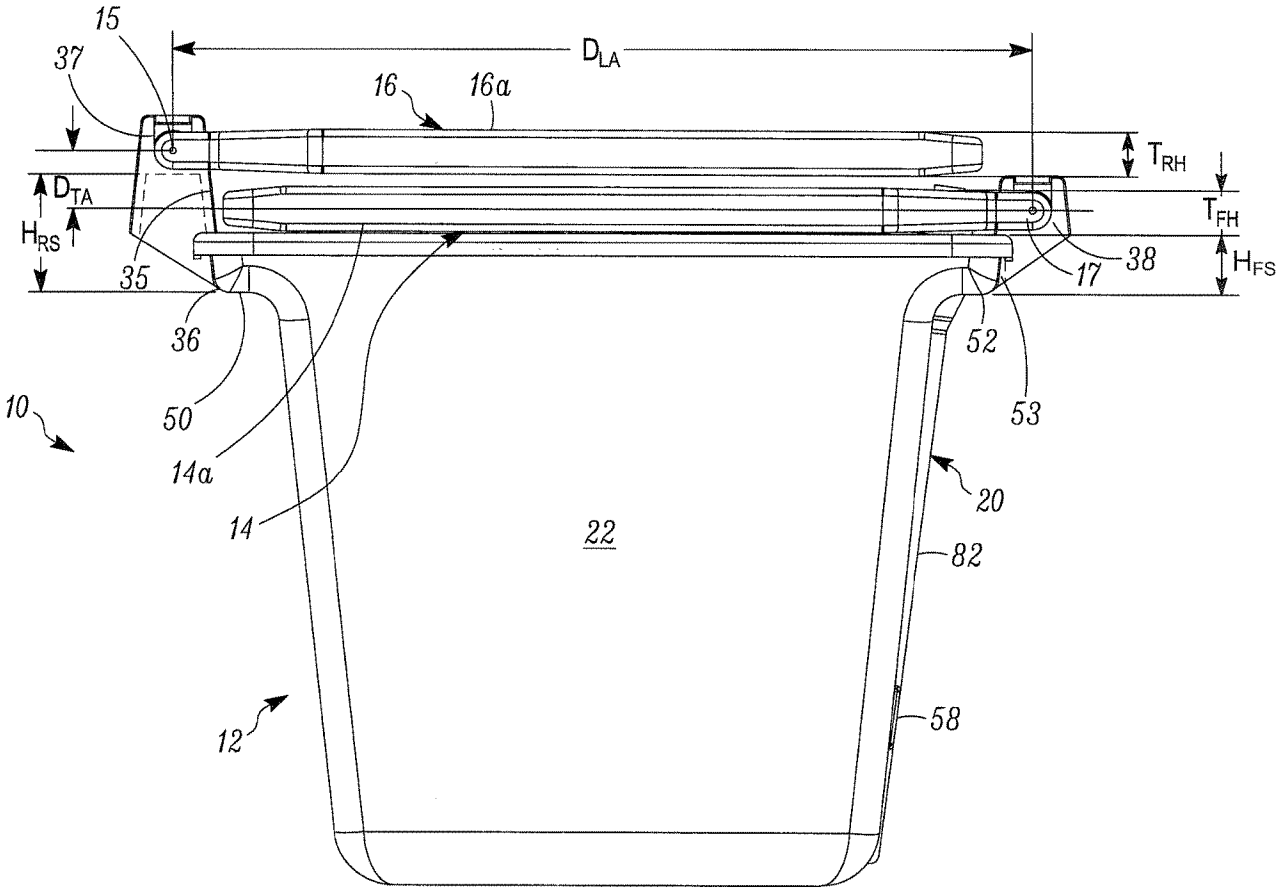
FIG. 6 is a side view of the holding device of FIG. 1, with the handles oriented in the folded-in position.

As shown in FIGS. 5 and 6, a distance between the front handle pivot axis 17 and the rear handle pivot axis 15 in a handle length direction is $d_{LA}$. A distance between the front handle pivot axis 17 and the rear handle pivot axis 15 in a handle thickness direction is $d_{TA}$.

In such circumstances, when arranged in the double-handle position as shown in FIGS. 1-3, the front handle 14 and the rear handle 16 come together in the center above the holder body 12, thereby allowing the holder body 12 to be arranged in an upright position, when the user holds the double-handles of the holding device 10 in one hand. The double-handle position allows the holding device 10 to be maintained stable for paint roller filling or transporting. However, it is to be understood that the front handle 14 and the rear handle 16 can be configured to have different side bar lengths or cross bar lengths to allow for example the holder body 12 to be oriented in a tilted position when the double handles are held in the user's hand.

As shown in FIGS. 1-3, the side bar length $L_S$ of the front handle 14 or the rear handle 16 is configured to be long enough to allow the user to easily fit a paint roller between a cross bar 14*a* or 16*a* and a top edge of the holder body 12 to which the respective handle 14 or 16 is attached, to fill the paint roller with paint without spilling paint or getting paint on the user's hands. Also, the cross bar length $L_C$ of the front handle 14 or the rear handle 16 is configured to be long enough to allow the user to easily fit an implement between the side bars.

In some embodiments, the length $L_S$ of the front and rear handles 14, 16 equals to the distance $d_{LA}$ between the front handle pivot axis 17 and the rear handle pivot axis 15 in a handle length direction. In such circumstances, an angle $\alpha$ of about 60° is formed between planes defined by the front handle 14 and the rear handle 16 when the handles 14, 17 are arranged in the double-handle position.

In some embodiments, the cross bar 14*a* of the front handle 14 and the cross bar 16*a* of the rear handle 16 can be made of a soft material to allow for a pliable gripping and cause less fatigue during extended use.

Referring to FIGS. 5 and 6, in some embodiments, the front handle 14 and the rear handle 16 can be arranged in a folded-in position. As discussed above, the front handle 14 and the rear handle 16 can each have a length that is generally equal to the distance $d_{LA}$ between the front handle pivot axis 17 and the rear handle pivot axis 15 in a handle length direction. In such circumstances, the front handle 14 is allowed to nest with the side wall 35 of the rear shelf 50 on the upper rims 30, 31 of the holder body 12.

As described above, in the depicted embodiment, the front handle pivot axis 17 is positioned lower than the rear handle pivot axis 15 relative to the upper rims 30, 31 of the first and second side walls 22, 23 of the holder body 12. In such circumstance, the front and rear handles can be positioned to allow the distance $d_{TA}$ between the front handle pivot axis 17 and the rear handle pivot axis 15 in a handle thickness direction can be slightly greater than ½ of a total of the thickness $T_{FH}$ of the front handle 14 and the thickness $T_{RH}$ of the rear handle 16. This configuration allows the rear handle 16 to be folded on top of the front handle 14 when the front handle 14 is nested on the upper rims 30, 31, with both handles 14, 16 positioned parallel to the upper rims 30, 31. This can help prevent the front handle 14 and the rear handle 16 from getting in the way of the user if the user holds the bottom 28 of the device 10. Further, this configuration permits the holding device 10 to stack with other holding devices during storage, transport, or display such as point of purchase display.

It is to be understood that the length of the front handle 14 or the rear handle 16 can vary as desired. For example, the length of the front handle 14 or the rear handle 16 can be configured to be smaller than the distance $d_{LA}$ between the front handle pivot axis 17 and the rear handle pivot axis 15 in a handle length direction as long as the a total of the length of the front handle 14 and the length of the rear handle 16 is greater than the distance $d_{LA}$, thereby allowing the front handle 14 and the rear handle 16 to be pivoted into the double-handle position described above. Also, as described above, the length of the front handle 14 or the rear handle 16 has to be long enough to allow the user to fit an implement such as a paint roller between a cross bar 14*a* or 16*a* and a top edge of the holder body 12 to which the respective handle 14 or 16 is attached.

Figure 4:
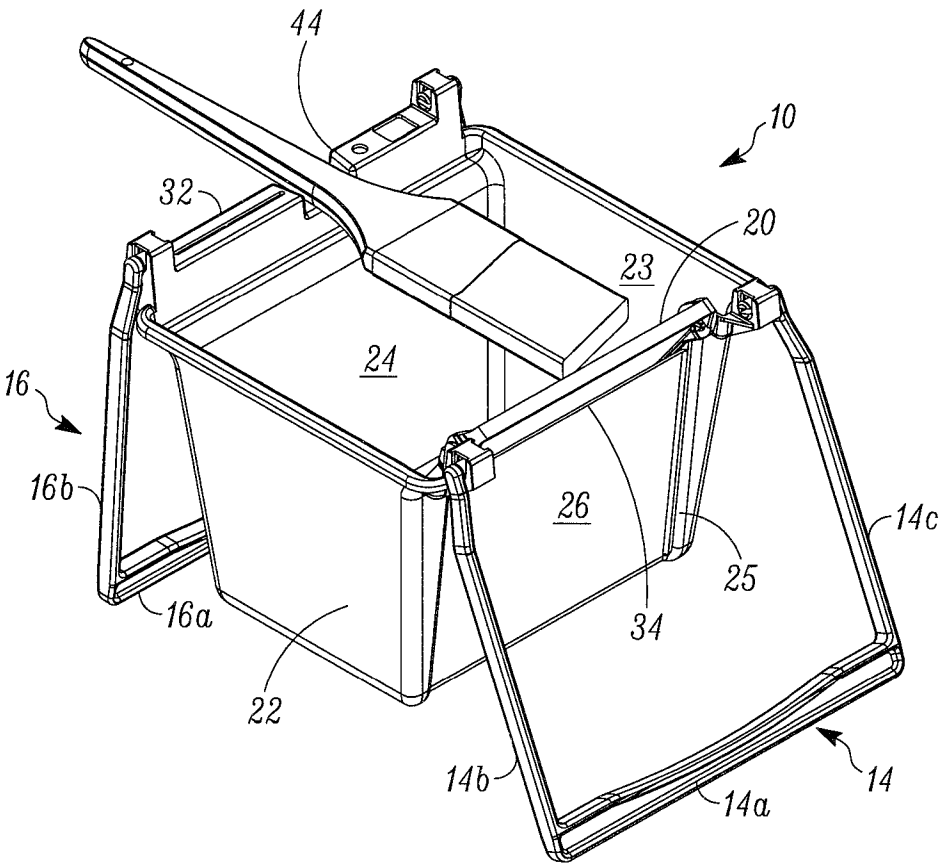
FIG. 4 is a perspective view of the holding device of FIG. 1, with a handle of a paint brush received in a holding channel formed on a rim of the holding device.
Figure 7:
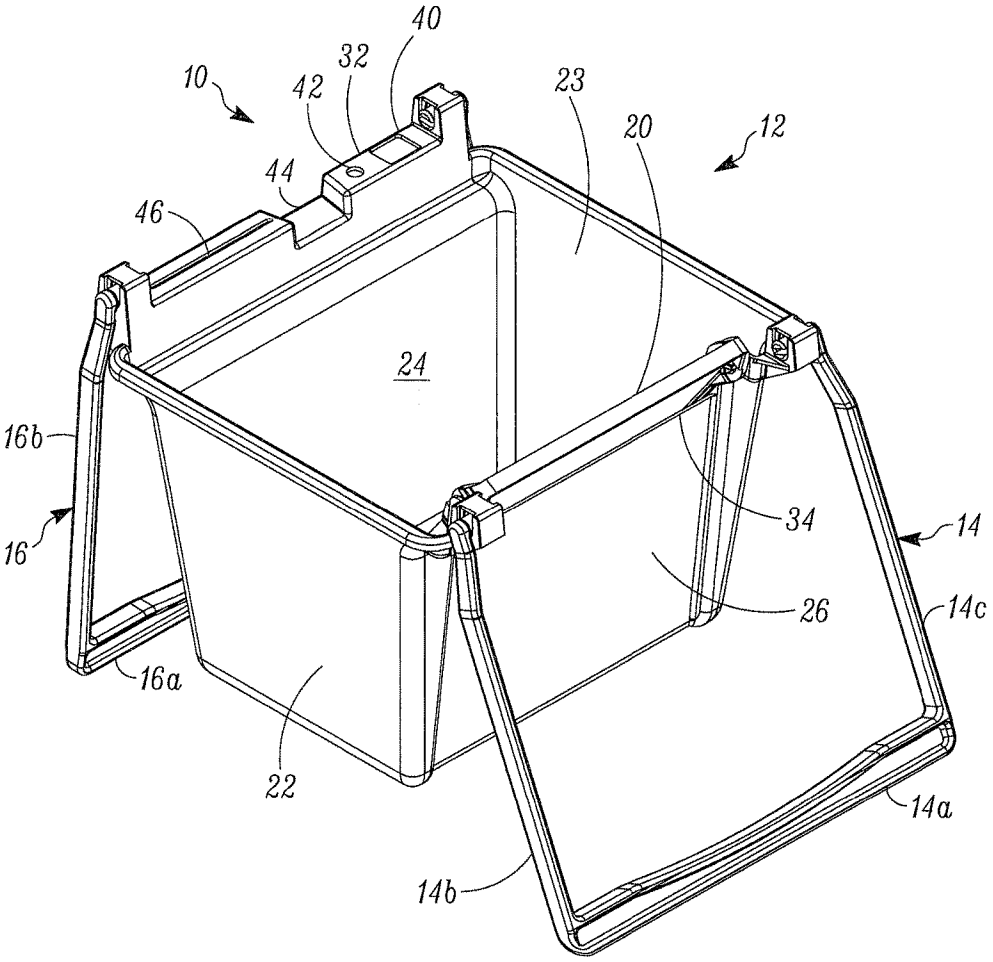
FIG. 7 is a perspective view of the holding device of FIG. 1, with the handles oriented in a folded-down position.

Referring to FIGS. 4 and 7, in some embodiments, the front handle 14 and the rear handle 16 can also be oriented to a folded-down position during use of the holding device 10 or during cleaning of the components of the holding device 10.

In some embodiments, each of the front and rear handles 14, 16 can be configured as a support brace for a back of the user's hand. For example, as shown in the embodiment depicted in FIG. 7, when the user holds the holding device 10 by grasping the hand grip 60 with his or her palm up, the front handle 14 can assist in support of the user's hand, such as working as a support brace for the back of the user's hand. In such instances, the cooperation of the hand grip 60 and the front handle 14 allows the user's fingers to hold the holding device 10 comfortably without tipping or sliding, thereby permitting the user to hold the device with less fatigue over an extended period of time. Also, the front handle 14 can assist in balancing the holding device 10 and preventing it from slipping out the grip, thereby allowing the user to orient the holding device 10 at an angle that is easy to fill the paint roller or brush with paint.

It is to be understood that when one of the front and rear handles 14, 16 is oriented in a folded-down position, the other handle can be oriented in other positions, such as a folded-in position.

Figure 8:
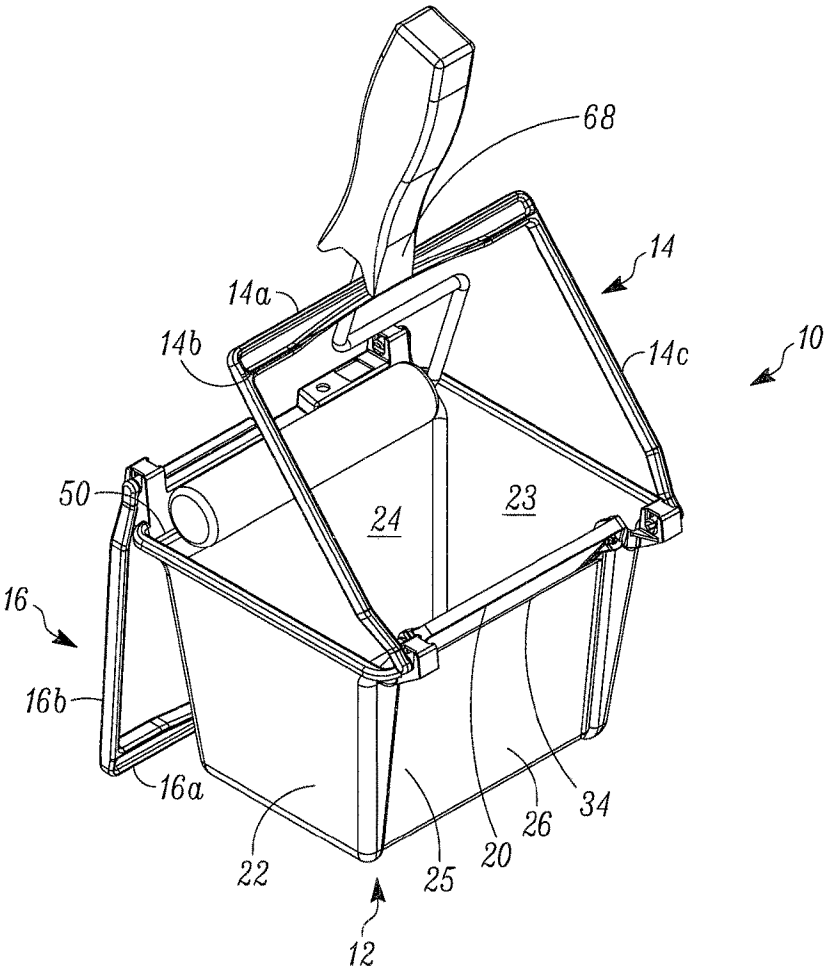
FIG. 8 is a perspective view of the holding device of FIG. 1, with the handles oriented in a further position for assisting in support of an implement.

Referring to FIG. 8, as discussed above, in some instances, when the user needs to avoid placing an implement, such as a roller portion of a paint roller, in the paint contained in the holding device 10, the user can place the roller portion on the bottom wall 33 of the rear shelf 50 formed on the rear wall 24 of the holder body 12 against the side wall 35 of the rear shelf 50, thereby allowing the roller portion to rest on the rear shelf 50. In such circumstances, the front handle 14 can be oriented in a position to assist in support of the paint roller. In the embodiment depicted in FIG. 8, the front handle 14 is oriented such that the cross bar 14*a* of the front handle 14 engages with an engagement element 68 formed on a handle portion or a shank portion of the paint roller, thereby assisting in support of the paint roller.

Referring now to FIGS. 1, 5, 9-10 and 12, in some embodiments, a pivotable paint roll-off panel 20 is used to assist in dispersing paint (or other fluid media) more evenly over a roller portion of a paint roller. As shown in the embodiment depicted in the figures, the panel 20 can be arranged in a working position to allow excess paint to be rolled off from a paint roller (referring to FIGS. 1 and 9) and arranged in a non-working position outside of the holder body 12 to provide a larger volume in the holder body 12 (referring to FIGS. 5, 10 and 12. In some embodiments, the panel 20 is attached to the front wall 26 of the holder body 12. However, it is to be understood that the panel 20 can be attached to other walls of the holder device 12, such as the first side wall 22, the second side wall 23, or the rear wall 24. The panel 20 may be integrally molded out of a suitable material, such as a plastic material.

Referring to FIGS. 1, 5, 9-10, the panel 20 may include a first, textured surface 80 facing at least partially upwardly when the panel 20 is oriented in the working position and a second surface 82 positioned opposite to the textured surface 80. The textured surface 80 may have a plurality of ribs, ridges, bumps or openings of any desired shape to create traction for aiding in dispersing the paint more evenly over the roller portion and allowing excess paint to drain back into the holder body 12 during roll-off processes. It is to be understood that a variety of textures can be employed to create the traction as needed. In the embodiment depicted in the features, the textures take a form of ribs, and the textured area is only formed on the first, textured surface 80, but not formed on the second surface 82. However, it is also to be understood that, in some embodiments, the second surface 82 can also include a textured area if desired.

Surrounding the first, textured surface 80 is a frame having an upper end 70, a lower end 72 and opposite sides 76, 78, with the side 76 positioned next to the first side wall 22 and the side 78 positioned next to the second side wall 23.

Figure 9:
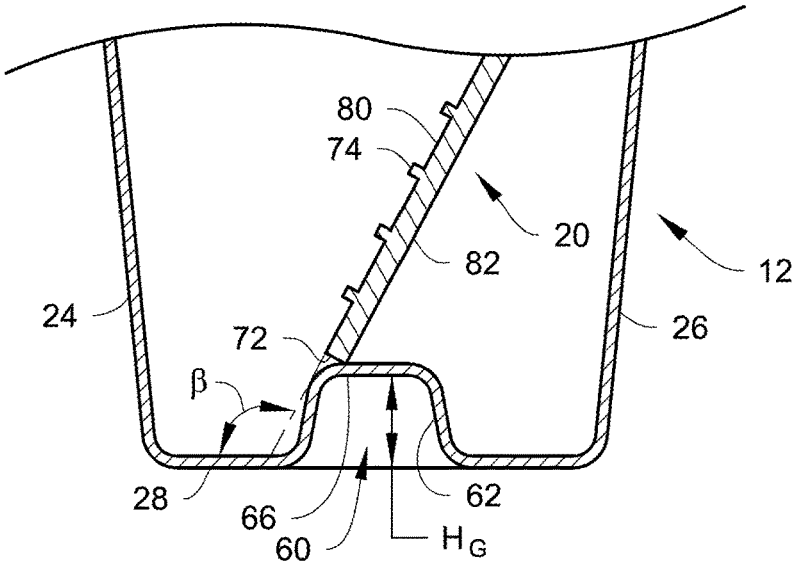
FIG. 9 is a partial cross sectional view of the holding device of FIG. 1 taken along line IX-IX, with the paint roll-off panel arranged in a working position.

Referring to FIGS. 1 and 9, when oriented in the working position, the first, textured surface 80 is oriented at an obtuse angle β relative to the bottom wall 28, thereby allowing for ease of rolling off the paint. In some embodiments, the top wall 66 of the hand grip 60 can be employed to aid in support of the lower end 72 of the panel 20, thereby allowing the panel 20 to be arranged in a slanted orientation as desired.

Figure 10:
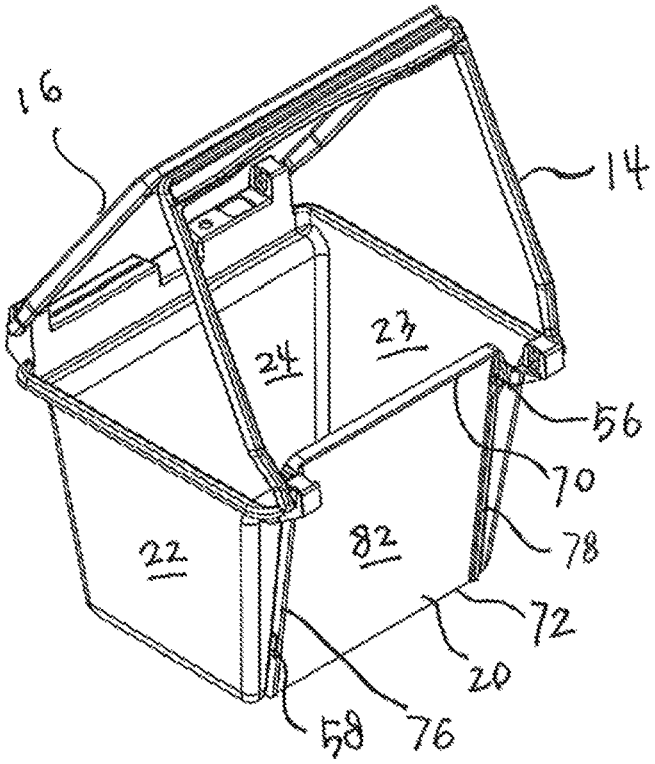
FIG. 10 is a perspective view of the holding device of FIG. 1, with the paint roll-off panel arranged in a non-working position.
Figure 11:
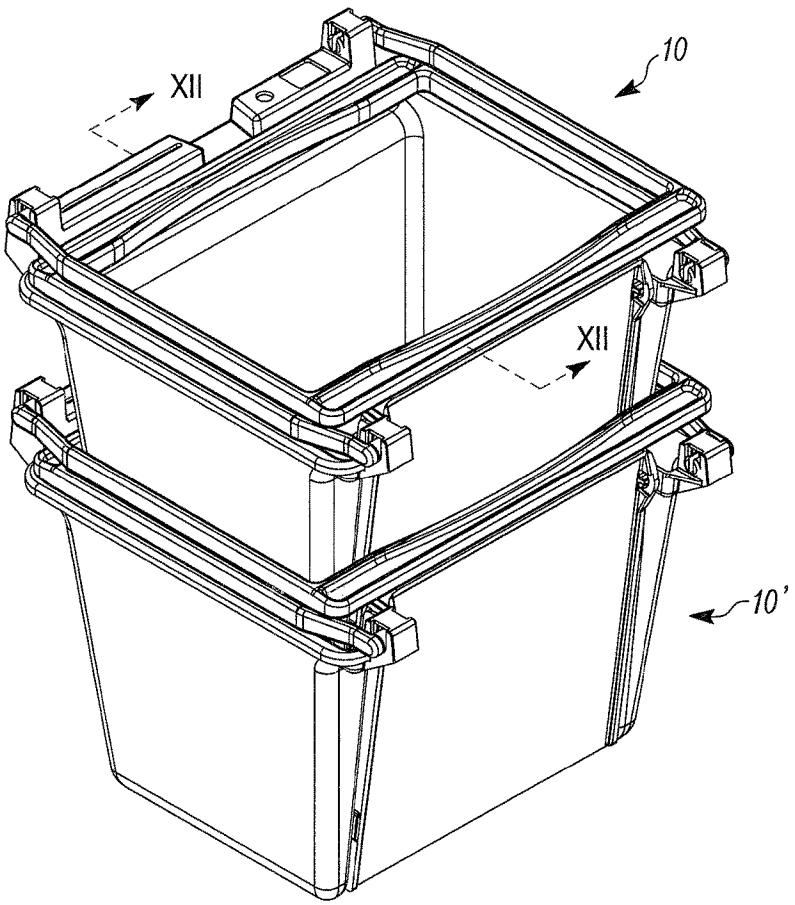
FIG. 11 is a perspective view of a plurality of the holding devices of FIG. 1 stacked during storage or transport, in accordance with some implementations.
Figure 12:
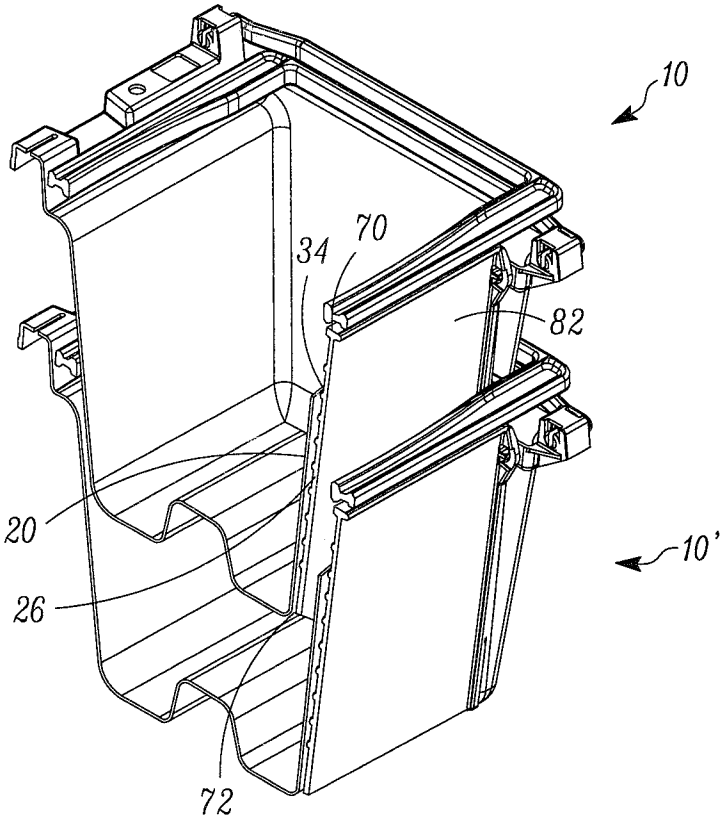
FIG. 12 is a cross sectional view of the plurality of the holding devices of FIG. 11 taken along line XII-XII.

Referring to FIGS. 5, 10 and 12, to pivot the panel 20 to the non-working position, the lower end 72 of the panel 20 is pivoted upwardly about attachment points 84 formed on the sides 76, 78 (for attaching the panel 20 to the front wall 26 of the holder body 12), pivoted outside of the holder body 12, and then folded downwardly to the non-working position. In such circumstances, the panel 20 is generally parallel to the front wall 26 of the holder body 12, with its second surface 82 facing away from the front wall 26. This non-working position allows the panel 20 to be folded out of the way if a paint brush, instead of a paint roller, is in use. The non-working position also provides a larger volume in the holder body 12 for ease of stacking during storage, transport or display. In some embodiments, the panel 20 is removable for ease of, for example, cleaning Referring to FIGS. 11 and 12, the holding device 10 may stack with other holding devices 10' during storage, transport or display, such as point of purchase display, thereby conserving storage space and promoting a secure stacking configuration. To allow proper stacking of the holding device 10 with other holding devices 10', the walls 22, 23, 24, 26 of the holder body 12 can be configured at a slight angle in a range of 0-45 degrees with respect to the bottom wall 28 of the holder body 12. Also, the handles 14, 16 can be oriented in a folded-in position to facilitate stacking, and the pivotable paint roll-off panel 20 can be positioned in a non-working position so as to facilitate stacking Optionally, a liner having generally the same basic configuration as the holder body 12 can be used to cover the inner surface of the holder body 12, thereby to minimize the need to clean the inside of the holder body 12.

Figure 13:
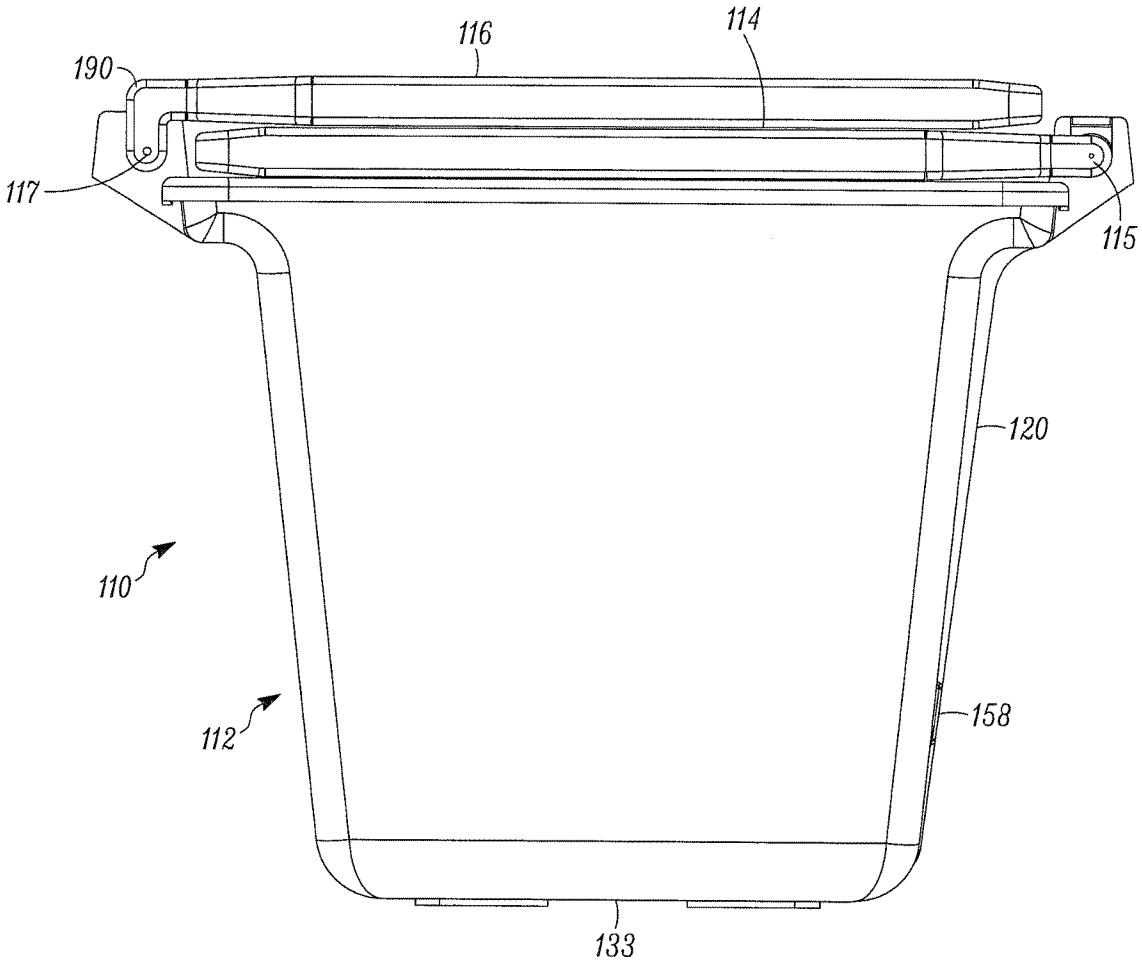
FIG. 13 is a side view of a further embodiment of fluid medium holding device, with the handles oriented in the folded-in position.

Referring now to FIG. 13, in some embodiments, a fluid medium holding device 110 includes a holder body 112, a front handle 114 and a rear handle 116 attached to the holder body 112, and a pivotable paint roll-off panel 120 retained to an outer surface of the holder body 112 by a retention element 158. The front handle 114 has a front handle pivot axis 115 and the rear handle 116 has a rear handle pivot axis 117. Unlike the embodiment depicted in FIGS. 1-12, in the embodiment depicted in FIG. 13, the front handle pivot axis 115 and the rear handle pivot axis 117 have a generally same elevation relative to a bottom wall 133 of the holder body 112 or a supporting surface on which the holding device 110 rests.

In such circumstances, the rear handle 116 can include a bent section 190 adjacent the rear handle pivot axis 117. As shown in the embodiment depicted in FIG. 13, in a folded-in position, the rear handle 116 is bent in an upward direction to offset the front handle 114. In such circumstances, when the front handle 114 rests on an upper edge of the holder body 112, the bent section allows the rear handle 116 to fold on the front handle 114 such that front and rear handles 114, 116 are positioned generally parallel to each other.

A number of embodiments of the invention have been described. Nevertheless, it will be understood that various modifications may be made without departing from the spirit and scope of the invention.

The invention claimed is:

1. A fluid medium holding device, comprising:

a holder body having a plurality of side walls, a bottom wall and an opening defined by the plurality of side walls that allows access to an interior space of the holder body;

a first handle attached to a first side wall of the plurality of side walls of the holder body, the first handle being pivotable about a first pivot axis;

a second handle attached to a first second side wall of the plurality of side walls of the holder body, the second handle being pivotable about a second pivot axis; and a pivotable panel attached to the first side wall, the pivotable panel is pivotable between a first position inside the holder body with the pivotable panel oriented in a slanted orientation relative to the bottom wall of the holder body, and a second position outside of the holder body, wherein the first handle and the second handle are foldable on an upper edge of the holder body with the first handle and the second handle positioned generally parallel to each other, and wherein a distance between the first pivot axis and the second pivot axis defines a length of the upper edge between the first side wall and the second side wall, the distance being generally equal to a length of the first handle, which is generally equal to a length of the second handle.

2. The fluid medium holding device of claim 1, wherein an outside surface of the first side wall has a recessed area extending inwardly toward the interior space of the holder body, the recessed area being defined by a pair of steps formed along two opposite side edges of the first side wall, the recessed area being configured to receive at least partially a thickness of the pivotable panel.

3. The fluid medium holding device of claim 1, wherein an elevated section is formed in the bottom wall of the holder body, allowing a lower end of the pivotable panel to rest on a top surface of the elevated section, the elevated section being elongate and extending along the first side wall and the second side wall.

4. The fluid medium holding device of claim 3, further comprising a hand grip that allows a user to grasp onto, the hand grip being corresponding to the elevated section, formed on the bottom wall and extending upwardly, the hand grip being cooperatable with the first handle or the second handle to allow the user to position the holding device at various angles.

5. The fluid medium holding device of claim 1, wherein the pivotable panel has a textured surface facing partially upwardly when the pivotable panel is positioned in the first position inside the holder body.

6. The fluid medium holding device of claim 5, wherein the pivotable panel is detachable.

7. The fluid medium holding device of claim 1, wherein the first pivot axis and the second pivot axis have different elevations relative to the bottom wall.

8. The fluid medium holding device of claim 1, wherein the second handle has a bent section that when the first handle is folded on an upper edge of the holder body, the second handle is bent in an upward direction to offset the first handle.

9. The fluid medium holding device of claim 1, wherein a lower portion of the holder body is nestable within an opening of a holder body of a further holding device in a stack of holding devices.

10. The fluid medium holding device of claim 1, further including a liner that lines an inner surface of the holder body.

11. The fluid medium holding device of claim 1, wherein a shelf is formed on top of the second side wall, thereby allowing a paint roller head to rest thereon.

12. The fluid medium holding device of claim 1, wherein an upper rim of the second side wall includes a holding aperture for holding a portion of a hand tool.

13. The fluid medium holding device of claim 1, wherein an upper rim of the second side wall includes a slot for receiving a blade of a hand tool, a rib being formed on a bottom surface of the upper rim extending transversely relative to the slot for preventing the blade from pivoting.

14. The fluid medium holding device of claim 1, wherein an upper rim of the second side wall includes a holding channel to receive a portion of a hand tool.

15. A fluid medium holding device, comprising:

a holder body having a plurality of side walls, a bottom wall and an opening defined by the plurality of side walls that allows access to an interior space of the holder body;

a first handle attached to a first side wall of the plurality of side walls of the holder body, the first handle being pivotable about a first pivot axis; and a second handle attached to a second side wall of the plurality of side walls of the holder body, the second handle being pivotable about a second pivot axis, wherein the first handle and the second handle are foldable on an upper edge of the holder body with the first handle and the second handle positioned generally parallel to each other, wherein an outside surface of the first side wall has a recessed area extending inwardly toward the interior space of the holder body, the recessed area being defined by a pair of steps formed along two opposite side edges of the first side wall, the recessed area being configured to receive at least partially a thickness of a pivotable panel, and wherein a retention element is formed on an outside surface of the first side wall to which the pivotable panel is attached and adjacent the recessed area to retain the pivotable panel in place along the outside surface.

16. A fluid medium holding device, comprising:

a holder body having a first side wall, a second side wall opposite to the first side wall, side walls extending between the first side wall and the second side wall, and a bottom wall;

a first handle attached to the first side wall of the holder body, the first handle being pivotable about a first pivot axis;

a second handle attached to the second side wall of the holder body, the second handle being pivotable about a second pivot axis; and a pivotable panel attached to the first side wall, the pivotable panel is pivotable between a first position inside the holder body with the pivotable panel oriented in a slanted orientation, and a second position outside of the holder body, wherein a first handle is nestable on an upper rim of the holder body, the second handle being foldable on top of the first handle such that a plane defined by the second handle is parallel to a plane defined by the first handle, and wherein a distance between the first pivot axis and the second pivot axis defines a length of the upper edge between the first side wall and the second side wall, the distance being generally equal to a length of the first handle, which is generally equal to a length of the second handle.

17. The fluid medium holding device of claim 16, wherein an elevated section is formed in the bottom wall of the holder body, allowing a lower end of the pivotable panel to rest on a top surface of the elevated section, the elevated section being elongate and extending along the first side wall and the second side wall.

18. The fluid medium holding device of claim 16, wherein the first handle has a length that is generally equal to a distance between the first pivot axis and the second pivot axis in a length direction of the first handle, and the second handle has a length that is generally equal to the distance between the first pivot axis and the second pivot axis.

* * * * *